US006149478A

United States Patent [19]

Lehmann

[11] Patent Number: 6,149,478

[45] Date of Patent: Nov. 21, 2000

[54] OUTBOARD MOUNTED ELECTRICAL POWER GENERATING APPARATUS FOR BOATS

[76] Inventor: Roger W. Lehmann, 808 Ashley Ave., Brielle, N.J. 08370

[21] Appl. No.: 09/503,815

[22] Filed: Feb. 15, 2000

Related U.S. Application Data

[60] Provisional application No. 60/121,112, Feb. 22, 1999.

[51] Int. Cl.[7] ..... B63H 21/00

[52] U.S. Cl. ..... 440/88; 440/900

[58] Field of Search ..... 440/88, 89, 900; 290/1 R, 1 B, 53; 363/146

[56] References Cited

U.S. PATENT DOCUMENTS

| | | | |
|---|---|---|---|
| 2,256,831 | 9/1941 | Karey . | |
| 2,582,776 | 1/1952 | Greenberg et al. . | |
| 2,603,202 | 7/1952 | Kiekhaefer . | |
| 2,684,635 | 7/1954 | Winkelman et al. . | |
| 3,160,252 | 12/1964 | Steinlein . | |
| 3,230,698 | 1/1966 | Nettles . | |
| 3,238,911 | 3/1966 | Pazulski . | |
| 3,545,585 | 12/1970 | Eaton . | |
| 3,619,632 | 11/1971 | Labombarde . | |
| 3,703,642 | 11/1972 | Balguer . | |
| 3,763,819 | 10/1973 | Mays . | |
| 3,812,379 | 5/1974 | Kaufman et al. . | |
| 4,010,377 | 3/1977 | McKenzie . | |
| 4,695,261 | 9/1987 | Broughton et al. . | |
| 4,746,808 | 5/1988 | Kaeser . | |
| 4,779,905 | 10/1988 | Ito et al. . | |
| 4,835,405 | 5/1989 | Clancey et al. . | |
| 4,987,953 | 1/1991 | Hedstrom . | |
| 5,011,442 | 4/1991 | Polcz et al. . | |
| 5,058,660 | 10/1991 | Hedstrom . | |
| 5,199,912 | 4/1993 | Dade et al. . | |
| 5,261,842 | 11/1993 | Hinkel, Jr. . | |
| 5,372,530 | 12/1994 | Holtermann et al. | 440/89 |
| 5,378,180 | 1/1995 | Nakayama et al. | 440/89 |
| 5,462,460 | 10/1995 | Kobaysahi . | |
| 5,863,231 | 1/1999 | Strong et al. | 440/89 |
| 5,911,610 | 6/1999 | Fujimoto | 440/89 |
| 6,033,273 | 3/2000 | Nozue et al. | 440/89 |
| 6,036,557 | 3/2000 | Morikami | 440/53 |
| 6,053,785 | 4/2000 | Kato et al. | 440/89 |
| 6,074,258 | 3/2000 | Arai et al. | 440/77 |

OTHER PUBLICATIONS

Motor Boating & Sailing Dec. 1999, pp. 18, 40.
Onan Product Literature 1999.

*Primary Examiner*—Matthew Nguyen
*Attorney, Agent, or Firm*—Caesar, Rivise, Bernstein, Cohen & Pokotilow, Ltd.

[57] ABSTRACT

An outboard-mounted, light-weight, self-contained, safe-operating internal combustion engine-driven generator system for use with boats for providing electrical power to on-board equipment (e.g., appliances and accessories such as air conditioners, cooking ranges, etc.) independent of water vessel motion or propulsion devices.

29 Claims, 4 Drawing Sheets

OUTBOARD MOUNTED ELECTRICAL POWER GENERATING APPARATUS FOR BOATS

RELATED APPLICATIONS

This application is an Application based on a Provisional Application Ser. No. 60/121,112 filed Feb. 22, 1999 entitled OUTBOARD MOUNTED ALTERNATOR FOR BOATS, whose entire disclosure is incorporated by reference herein.

FIELD OF THE INVENTION

The present invention relates to electrical power generators and, more specifically, to electrical power generators for use with water vessels for powering on-board equipment independent of water vessel motion or propulsion devices.

BACKGROUND OF THE INVENTION

The operation of onboard electrical appliances and electrical conveniences (e.g., air conditioners, cooking ranges, microwaves, electric fans, televisions, video cassette recorders, refrigerators, freezers, coffee pot, blenders, hot water heaters, flood lighting, battery-chargers, computers, etc.) are generally limited for use by the boater while the boat is tied at a dock where electric power can be supplied by a removable shore power cable connection to the boat. However, once the boat leaves the dock, the convenient use of 120/240 VAC electric power is not available and, in addition, the boat's standard 12VDC battery system is not capable of operating these high power consuming appliances and accessories. Therefore the convenience and enjoyment of these appliances and accessories is limited only to dock-side use. Thus, once the boat is underway, e.g., on the lake, or open sea, etc., some type of independent electrical power source on the boat itself is required. In fact, the marine industry has recognized that " . . . finding room for a genset can be a problem, especially in boats in the less-than-40-foot range." Motor Boating & Sailing/December 1999; p. 18, and "Mainship, like most manufacturers tries to provide as many amenities as possible that can be used when underway or at anchor. But, finding room for a genset can be a problem, especially in boats in the less than 40 foot range." Motor Boating & Sailing/December 1999.

Portable power generators, typically used at remote locations, such as campsites, cannot be used onboard boats because of their inherent hazards, such as hot exhaust gases, carbon monoxide hazard, combustion, exposure to salt water (e.g., being temporarily submerged by a wave) etc. Typically, these power generators comprise an internal combustion engine whose mechanical energy is converted into electrical energy by driving electric generators. Generators of this type use a small internal combustion engine that is air-cooled with low horsepower ratings (generally under 15 horsepower), similar to what is used in lawn mowers. In addition, the heat and fumes produced from the exhaust gases of the internal combustion engine require that the generator sets be operated outdoors in open spaces, away from any hazards. Also, the internal combustion engines must operate at continuously high RPMs to maintain the proper alternating current and voltage frequency required, typically, 50–60 Hz. Their operation produces an inordinate amount of noise and vibration. As a result, these types of generator sets are most suitable for use only outdoors where there is adequate ventilation and fresh air to cool and ventilate the unit for safe operation. In other words, these types of generators are not intended for marine applications. There have been attempts to enclose these portable air-cooled generator sets to quiet the noise produced, but the attempts have not been entirely satisfactory to quiet the noise from the internal combustion engine, muffle its exhaust system and dampen all the associated vibration of the generator set and the housing.

These portable air-cooled generating sets are not intended to be used aboard boats because of the confined space and hazards onboard a boat. Their use in confined spaces on boats introduces several risks and hazards. The hot exhaust fumes are a hazard that can burn crew members or ignite materials aboard the boat, thereby creating a fire hazard. The carbon monoxide gases from the exhaust can settle into bilges and cabin areas of the boat causing the hazard of carbon monoxide poisoning. The potential for the generator set to be exposed to water, i.e., becoming wet, splashed or even submerged while operating on a boat, can create explosive and electrical shock hazards to crew members with great risk of injury or death.

To provide electrical power onboard a boat for use away from the dock while underway, the boater's only option is to install a special inboard power generating system that is expensive, heavy, and requires large space below decks and has associated hazards of operation. These inboard power generating systems utilize an internal combustion engine to power a generator to supply large, on-demand electricity, to operate electrical appliances and accessories. This type of electrical generating system is mounted inside the boat's hull in a special compartment generally located under the boat's deck. This necessitates special installation requirements to permit safe operation because of the hazards in operating internal combustion engines in such an enclosed space. For example, in order to cool the hot engine, a raw water intake must be located below the water line through a hull fitting and a pump must be installed to circulate the raw sea water to cool down both the engine and hot exhaust gases to safe operating temperatures. This installation also requires special exhaust plumbing to safely remove dangerous hot exhaust gases through special water cooled mufflers and additional through-hull exhaust fittings; thus, the holes in the hull of the boat must be water-tight to keep water out. The use of highly combustible fuels such as gasoline in enclosed compartments requires further special safety measures. This type of a below-deck power generating system requires special vents to supply air to feed the internal combustion engine while simultaneously being water-tight to prevent water from contacting the unprotected electrical power plant during operation.

Other disadvantages are that these below-deck generators sets are themselves heavy and, therefore, increase the weight of the boat. For example, Onan, a subsidiary of Cummins Engine Company of Columbus, Ind., manufactures several marine generator sets, such as models 5.5 MDKUB/8.5MDKUB-380 lbs.; 7.0 MDKAL/9.0MDKL-610 lbs.; 8.0 MDKWB/10.0MDKWB-450 lbs. and 9.5 MDKAA/11.5MDKAA-695 lbs. Phasor Marine, of Pompano Beach, Fla., manufacturers a marine generator set Model K3-5.5KW that weighs approximately 380 lbs.; Kohler of Kohler, Wisconsin, manufactures a marine generator set Model 5E-5K that weighs approximately 205 pounds. One boat manufacturer, namely, Mainship of Luhrs Marine Group of St. Augustine, Fla., manufactures a boat Pilot/Pilot Sedan that utilizes a Kubota generator set (UCM1-3.5) that utilizes a single-cylinder diesel generator and that weighs approximately 160 lbs.; however, this does not include the additional weight and space required for remote muffler components (e.g., mufflers, hoses, seacocks, etc.) which also increase the overall weight. A large portion of this weight can be attributed to the iron-cast internal combustion engines used in the generator sets, as well as the elaborate muffler systems necessary for muffling the sound, and cooling the exhaust gases, of the generator-set engine. These muffler systems occupy a large space, thereby diminishing the below-deck space. Thus, this type of inboard power generating system is complex, heavy, expensive to install, subject to many safety hazards while operating and is physically limited only to larger boats usually over 36 feet in length, which have ample space below deck for such an installation. Thus, this type of below-deck electric generation installation is complex, expensive and subject to many hazards and can only be achieved where the proper below-deck space is available to meet all these safety requirements. As a result, small boats just do not provide sufficient space to safely install an electrical power generating system.

Another alternative for providing onboard electrical power is via the use of inverters that convert DC battery power into AC electrical power. However, several disadvantages also exist in using inverters. For example, the inverters are only good as long as there is battery power; once the boat's battery(ies) are depleted, the inverters are rendered useless, along with all other electrical components requiring the battery power. In addition, inverters are rather expensive, especially those required for powering appliances such as refrigerators, freezers, etc; furthermore, when inverters are used, additional batteries are required to avoid depleting the boat's batteries, thereby further increasing the cost and weight to the boat. As a result, the typical boater most likely will not invest in an inverter, knowing that its power is limited by the boat's battery(ies) power in any case.

The following U.S. patents are cited as examples of attempts to provide electrical power to onboard equipment but suffer from one or more of the problems discussed above, and/or are dependent upon the boat's propulsion device or the boat's motion.

U.S. Pat. No. 3,619,632 (Labombarde) discloses an outboard generator unit for sailboats. The outboard generator unit comprises a housing a After the claim is filled and then you go to proceed to empty it when you lift up the liner will create a suction cause the bag to affix itself to the liner. Remember when you tried to pick up an upside-down glass filled with water from a table? You can not do it without air passing in front of the glass. rranged to be attached to the transom of a sailboat and including a generator. A propeller is mounted in a housing coupled via a drive shaft to the generator so that when the sailboat is moving through the water, the propeller is rotated, thereby rotating the generator and producing electricity. The electricity is then fed via cables back to a battery for the inboard propulsion system of the sailboat, that is, its engine.

U.S. Pat. No. 4,010,377 (McKenzie) discloses a generator mounted on a propulsion unit of an outboard motor through an interposed adaptor. The adaptor includes various plug receptacles into which electrical plugs can be connected to provide electrical power to electrical appliances in the boat on which the unit is mounted. Electric power is provided thus by the operation of the propulsion motor.

U.S. Pat. No. 5,011,442 (Polcz et al.) discloses an auxiliary power generating means for outboard motors including an alternator adapted for installation between the flywheel and the recoil starter of an outboard engine. The auxiliary power generation device includes output electrical connections for providing electrical power to electrical appliances on the boat.

U.S. Pat. No. 3,812,379 (Kaufman et al.) discloses a combination propulsion system for boats. The propulsion system is an outboard mounted unit including a gasoline engine and an electric motor and means for coupling the motor to the engine, whereby the electric motor can be reversed and uses a generator when the engine is running. In this mode of operation, the battery for the motor can be recharged.

Thus, there remains a need for an electrical generating system to provide an economical, safe, reliable, and quiet means of generating electricity for small boats independent of the boat's propulsion system and independent of the boat's motion when the boat is away from the dock and away from the convenience of shore side electrical power.

OBJECTS OF THE INVENTION

Accordingly, it is the general object of this invention to provide an apparatus which improves upon and overcomes the disadvantages of the prior art.

It is another object of this invention to provide a solution to a long felt need of safely generating electrical power for onboard equipment on a water vessel (e.g., power boats, sailboats, boats using outboard engines, inboard/outboard engines, inboard engines, or sails, etc.) that is away from a dock or shore.

It is another object of this invention to provide an apparatus for supplying electrical power to onboard equipment on a water vessel (e.g., power boats, sailboats, boats using outboard engines, inboard/outboard engines, inboard engines, or sails, etc.) that is away from a dock or shore and wherein the apparatus is specially-designed for marine applications.

It is another object of this invention to provide an apparatus for supplying electrical power to onboard equipment on a water vessel (e.g., power boats, sailboats, boats using outboard engines, inboard/outboard engines, inboard engines, or sails, etc.) that is away from a dock or shore and wherein the apparatus is specially-designed for boats with little or no deck space, as well as for those boats with little or no below-deck space.

It is another object of this invention to provide an apparatus for supplying electrical power to onboard equipment on a water vessel (e.g., power boats, sailboats, boats using outboard engines, inboard/outboard engines, inboard engines, or sails, etc.) that is away from dock or shore and whereby the power generated is independent of the water vessel's propulsion unit.

It is still another object of this invention to provide an apparatus for supplying electrical power to onboard equipment on a water vessel (e.g., power boats, sailboats, boats using outboard engines, inboard/outboard engines, inboard engines, or sails, etc.) that is away from dock or shore and whereby the power generated is independent of the water vessel's motion.

It is still another object of this invention to provide an apparatus for supplying electrical power to onboard equipment on a water vessel (e.g., power boats, sailboats, boats using outboard engines, inboard/outboard engines, inboard engines, or sails, etc.) where no electrical service is part of the water vessel's structure.

It is still yet a further object of this invention to provide an apparatus for supplying electrical power to onboard equipment on a water vessel (e.g., power boats, sailboats, boats using outboard engines, inboard/outboard engines, inboard engines, or sails, etc.) that minimizes noise and vibration during operation of the apparatus.

It is still yet another object of this invention to provide apparatus for supplying electrical power to onboard equipment on a water vessel (e.g., power boats, sailboats, boats using outboard engines, inboard/outboard engines, inboard engines, or sails, etc.) that requires no below-deck space for installation.

It is still yet another object of this invention to provide an apparatus for supplying electrical power to onboard equipment on a water vessel (e.g., power boats, sailboats, boats using outboard engines, inboard/outboard engines, inboard engines, or sails, etc.) that minimizes fume and combustion hazards by being mounted outboard of the boat.

It is still yet another object of this invention to provide an apparatus for supplying electrical power to onboard equipment on a water vessel (e.g., power boats, sailboats, boats using outboard engines, inboard/outboard engines, inboard engines, or sails, etc.) that is light-weight in comparison to conventional generator sets used onboard boats.

It is even a further object of this invention to provide apparatus for supplying electrical power to onboard equipment on a water vessel (e.g., power boats, sailboats, boats using outboard engines, inboard/outboard engines, inboard engines, or sails, etc.) that can be used in fresh water or sea water.

It is even yet a further object of this invention to provide an apparatus for supplying electrical power to onboard equipment on a water vessel (e.g., power boats, sailboats, boats using outboard engines, inboard/outboard engines, inboard engines, or sails, etc.) that utilizes water-cooling for maximum electrical power generation.

It is still yet another object of this invention to provide an apparatus for supplying electrical power to onboard equipment on a water vessel (e.g., power boats, sailboats, boats using outboard engines, inboard/outboard engines, inboard engines, or sails, etc.) that avoids an elaborate muffler system.

SUMMARY OF THE INVENTION

These and other objects of the instant invention are achieved by providing an apparatus for generating electrical power for equipment on board a water vessel (e.g., power boats, sailboats, boats using outboard engines, inboard/outboard engines, inboard engines, or sails, etc.) that is away from dock or shore. The apparatus comprises: a motor (e.g., an internal combustion engine) coupled to a fuel source and wherein the motor operates by consuming fuel from the fuel source; an exhaust plenum, having an output portion submerged in the water, is coupled to the motor for removing exhaust gases generated by the motor via the output portion and wherein the motor drives an electrical generation means (e.g., an alternator/generator) for generating electrical power (e.g., 120VAC/240VAC @ 50–60 Hz) for use by the equipment; a cable coupled between the electrical generation means and at least one onboard electrical outlet to which the equipment is electrically-coupled; a housing, containing the motor and the electrical generation means, and further comprises coupling means for coupling to the boat. The apparatus operates independent of any propulsion device of the watervessel and operates independent of water vessel motion.

DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 1:
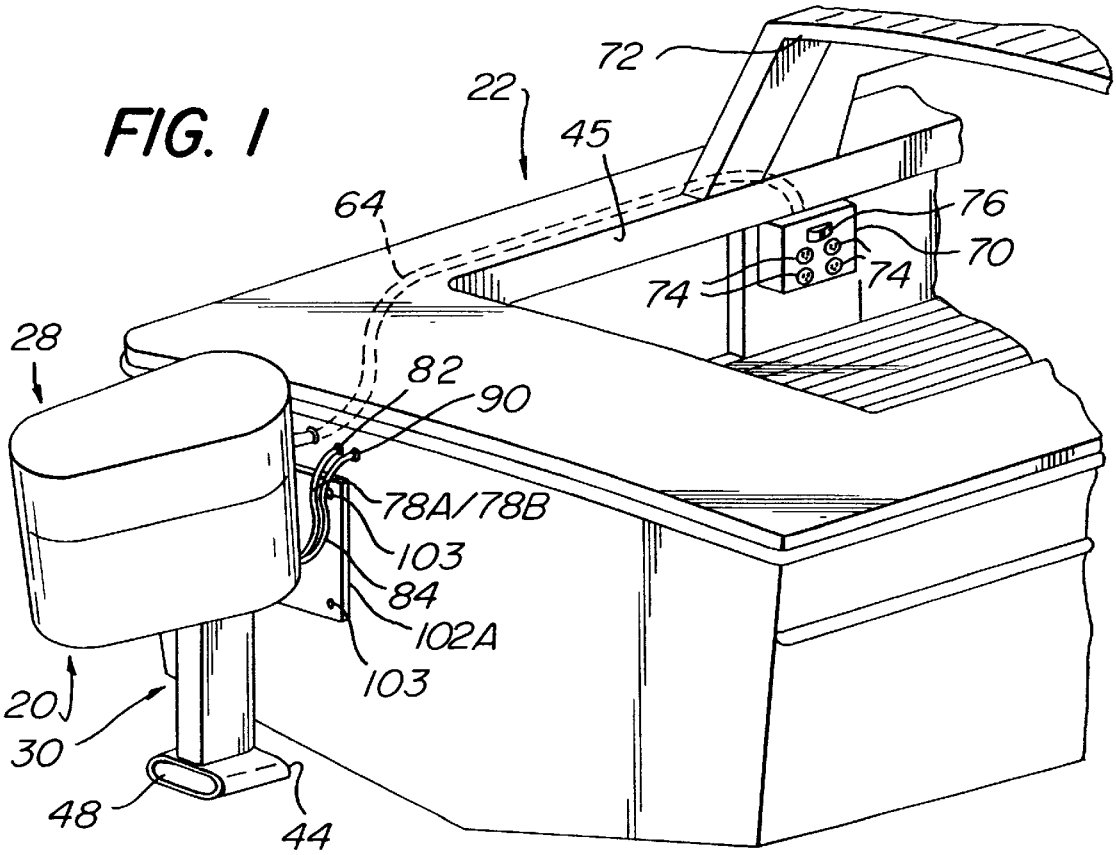
FIG. 1 is an isometric view showing the present invention releasably coupled at the stern of an inboard-powered boat shown in portion.
Figure 3:
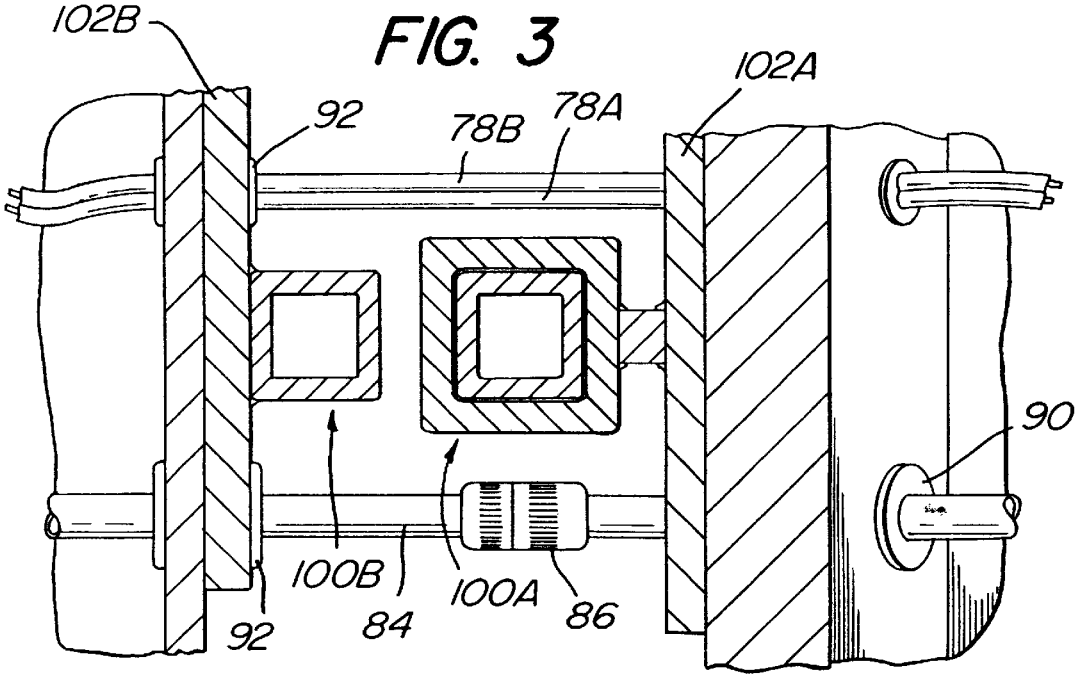
FIG. 3 is a cross-sectional view of a releasable coupling mechanism taken along line 3—3 of FIG. 2.
Figure 2:
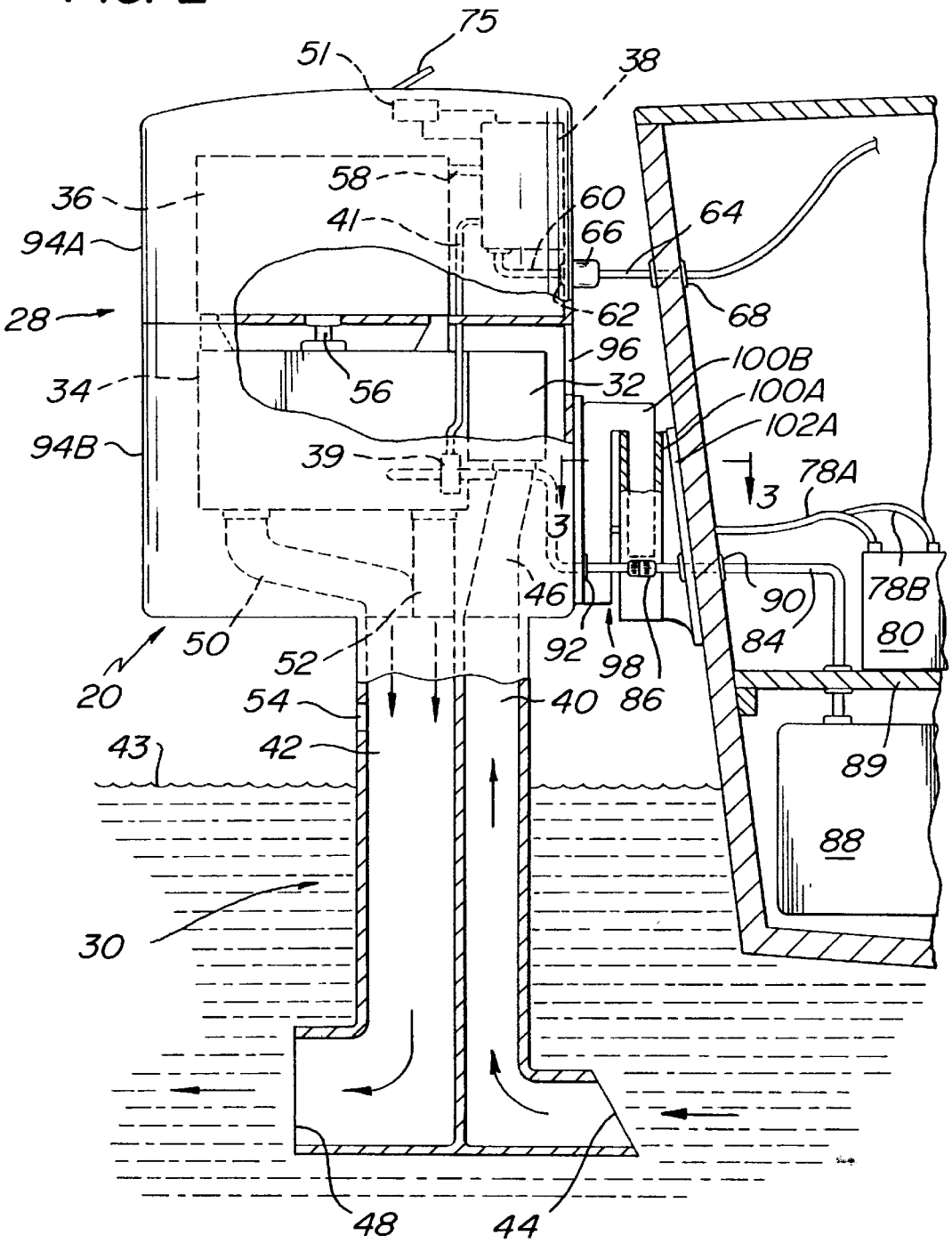
FIG. 2 an elevated cross-sectional view of the present invention coupled at the stern of the inboard-powered boat.
Figure 4:
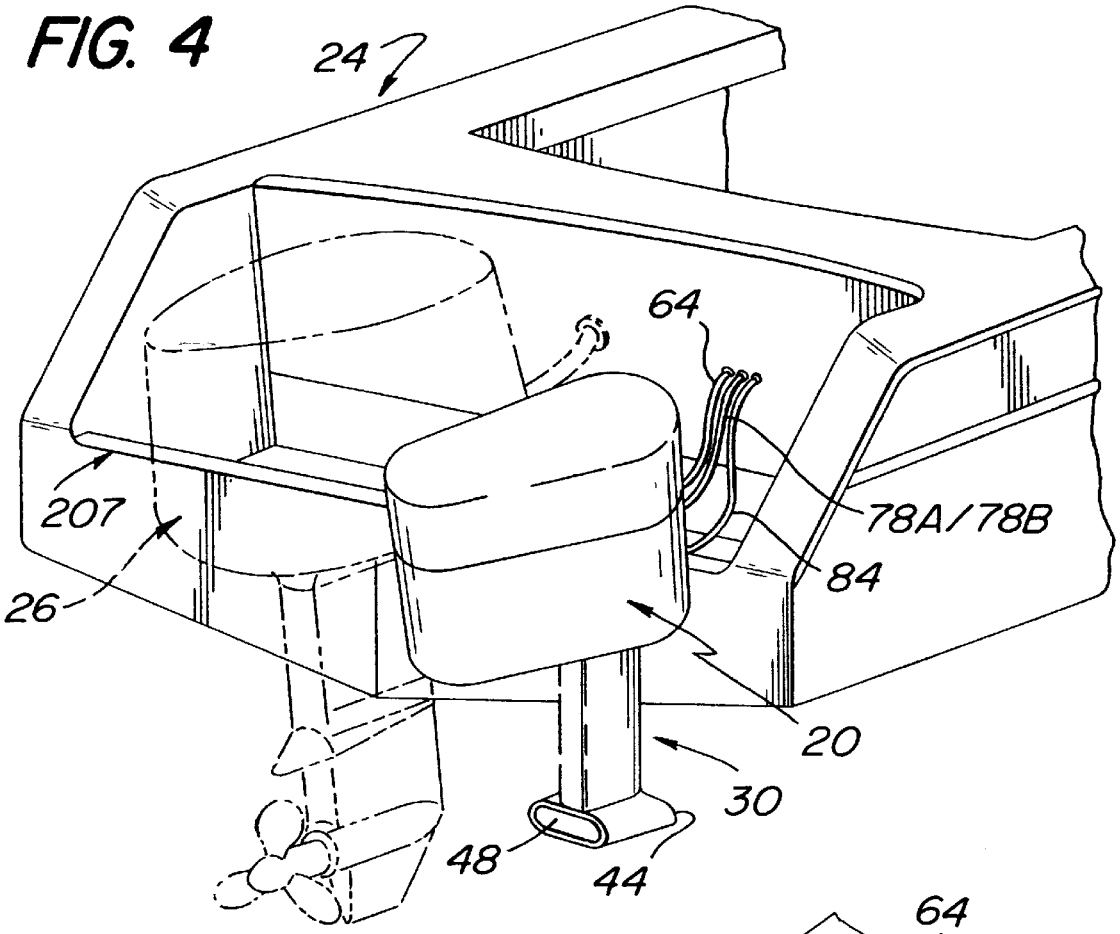
FIG. 4 an isometric view showing the present invention coupled at the stem of an outboard-powered boat shown in portion.
Figure 5:
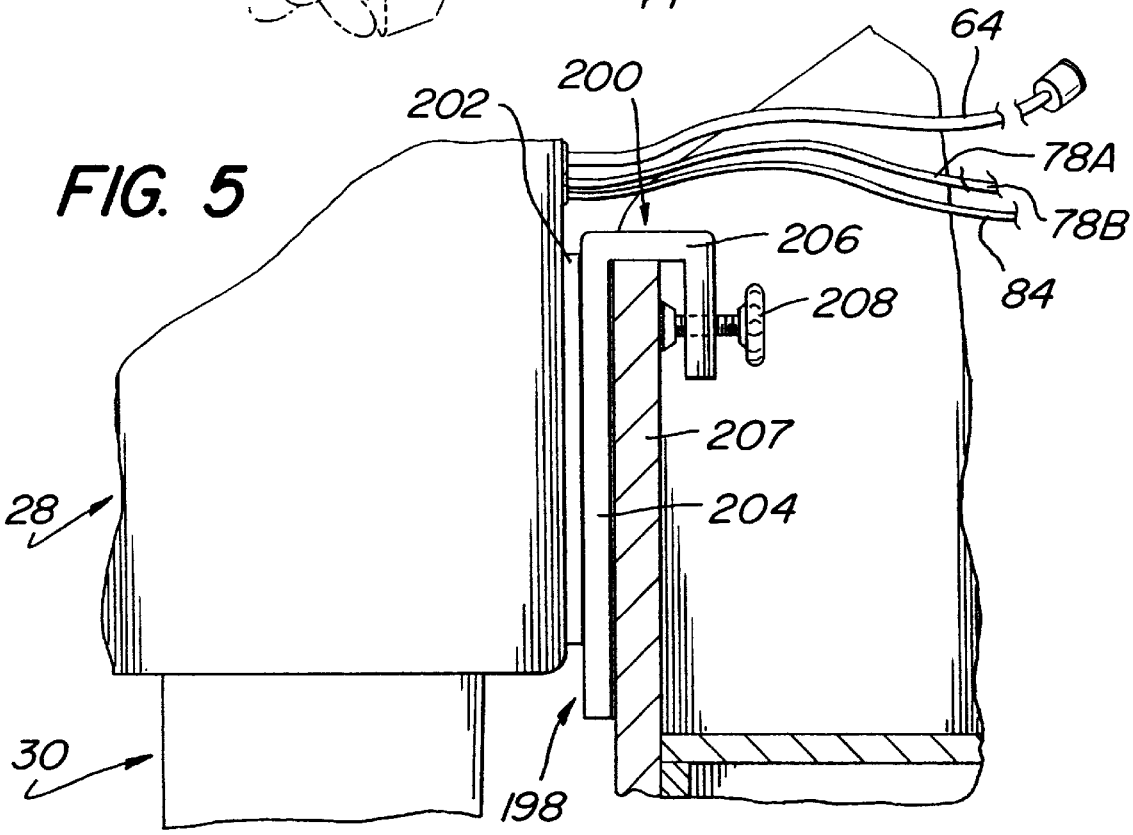
FIG. 5 is an enlarged view of another releasable coupling mechanism for coupling the present invention to the stern of the boat shown in FIG. 4.

Referring now in detail to the various figures of the drawing wherein like reference characters refer to like parts, there is shown at 20 an outboard mounted electrical power generating apparatus for boats. In general, the apparatus 20 can be used with power boats, sailboats, boats using outboard engines, inboard/outboard engines, inboard engines, or sails, etc. By way of example only, FIGS. 1–3 show the apparatus 20 being used with an inboard-powered boat 22 while FIGS. 4–5 show the apparatus 20 being used with an outboard-powered boat 24 with the outboard propulsion device 26 being shown in phantom.

For example, the outboard mounted apparatus 20 can be used with outboard powered boats, e.g., Bayliner 23, Scout 26, Seadan 360WA, Glacier Bay 26, Grady-White 26, Pro-Line 30, Century 31. The alternator 20 can also be used with inboard/outboard powered boats, e.g., Larson 22, Doral 25, Maxum 27, Bayliner 28, Sea Ray 29, Monterev 30, Osprey 30 and the Crusiers 36. The alternator 20 can also be used with inboard powered boats, e.g., Shamrock 27, Penn Yan 27, Campion 21'-Chase 630, Campion 26'-Chase 800, Campion 30'-Chase 910, Fountaine Pajot 34, Luhrs 34 and the 3055 Ciera. These powerboats are typically in the range of 22–35 feet and the sailboats are typically in the range of 22–38 feet, although these may vary.

It should be understood that the apparatus 20 does not form any part of a boat propulsion device (outboard nor inboard) and, therefore, the apparatus 20 could be coupled outboard anywhere along the boat's perimeter. The reason that the location of the apparatus 20 is shown at the stem of the boat (e.g., the transom of the boat) is that access to the boat fuel source/battery is most easily achieved at the stern of the boat. In addition, the location of the apparatus 20 at the stern of the boat is preferred to avoid disturbing the streamline flow of water around the boat hull during boat movement. In addition, the position of the apparatus 20 is off-center of the boat's 22/24 center to keep turbulence to the intake plenum 40/exhaust plenum 42 (as will be discussed in detail later) to a minimum that may be caused by the inboard propulsion device (not shown but located at the boat's center line) or caused by the outboard propulsion device 26 (FIG. 4).

Furthermore, because the apparatus 20 is mounted outside of the boat 22/24, fuel hazards, exhaust hazards, hull leakage and noise are avoided and/or minimized, thereby making the apparatus 20 a much safer electrical power generating device compared to inboard electrical power generating devices. In addition, because the apparatus 20 is mounted outboard there are no hazardous through-hull fittings located below the boat's 22/24 water line that can fail and, as a result, complications associated with below deck installation are avoided.

The apparatus 20 comprises a housing 28 and a submergible extension 30. As shown most clearly in FIG. 2, the housing 28 contains a raw-water, self-priming pump 32, a motor 34 (e.g., an internal combustion engine), an alternator/generator 36 and an electrical control circuit 38. The submergible extension 30 comprises an intake plenum 40 and an exhaust plenum 42, both of which extend below the bottom surface of the boat 22/24.

The intake plenum 40 includes an inlet 44 that is submerged in the water, while the other end of the intake plenum 40 is coupled to the raw-water, self-priming pump 32, inside the housing 28, via a conduit 46 (e.g., a hose, line, etc.). The inlet 44 forms a forward-facing (i.e., in the forward direction of the boat) scoop that facilitates input flow of the continuous supply of raw water when the boat 22/24 is moving forward. The exhaust plenum 42 includes a rear-facing outlet 48 that is also submerged in the water for expelling both motor exhaust gases and raw water return. In particular, the upper end of the exhaust plenum 42 is coupled to the exhaust stage (not shown) of the motor 34 via a conduit 50 and is also coupled to the motor cooling path (not shown) via another conduit 52. In addition, the upper portion of the exhaust plenum 42 comprises an exhaust vent 54 that is positioned above the water line 43 in order to prevent a negative pressure in the exhaust plenum 42 during engine start-up and to reduce exhaust gas back pressure in the exhaust plenum 42 when the boat 22/24 is not making headway, i.e., when the boat is stationary.

It should be understood that for large alternator/generators 36 (e.g., 4 kW and greater), it may be necessary to water-cool the alternator/generator 36 also. It within the broadest scope of this invention to include an alternator/generator 36 cooling path whereby another conduit (not shown) is coupled between the pump 32 and the alternator/generator 36 for routing some of the water intake into the alternator/generator 36 for cooling purposes and then exhausting the cooling water through an exit conduit (also not shown) that is coupled between the alternator/generator 36 and the exhaust plenum 42.

The pump 32 is coupled to the motor 34 and is an engine-driven, self-priming raw water pump that draws in water through the intake plenum 40 and then feeds the water into the motor 34 (and, where appropriate, through the alternator/generator 36) for cooling purposes. Thus, the pump 32 provides a continuous supply of water to cool the motor 34 during operation. It should be understood that the operation of the apparatus 20 does not require the boat 22/24 to be moving. The pump 32 is self-priming and therefore provides the requisite suction to maintain a continuous supply of water into the intake plenum 40. Forward motion of the boat only facilitates this input water flow into the intake plenum 40.

The output of the motor 34 is directly coupled to the alternator/generator 36 via a shaft 56. Thus, when the motor 34 (e.g., an internal combustion engine) is operating, it drives the alternator/generator 36, thereby generating raw, unregulated electrical power.

This unregulated electrical power is fed to the electrical control circuit 38 through internal conductors 58. The electrical control circuit filters and regulates the input electrical power. Thus, the output of the electrical control circuit 38 can be:

1.2 kW rated: 10 amps @ 120VAC;
2.3 kW rated: 19.2 amps @ 120VAC;
3.0 kW rated: 25 amp @ 120VAC, or 12.5 amp @ 240VAC; and
4.0 kW rated: 32 amp @ 120V, or 16.6 amp @ 240V.

The regulated power output (120VAC, and/or 240 VAC, @ 50–60 Hz) is fed through other internal conductors 60 and made available at a connector 62 (e.g., a male connector). A flexible, insulated, multiconductor power cable 64 having a water-proof plug 66 (e.g., a female connector) is coupled to the connector 62 to provide the electrical power to the boat 22/24. The power cable 64 is routed through the boat hull using a water-proof grommet 68. The power cable 64 (approximately 20 feet in length) is routed and secured under the boat's inboard trim 45. The other end of the power cable 64 also comprises another connector (not shown) that mates with a connector on the boat's inboard AC distribution panel; the panel includes electrical circuit breakers, gages, outlets and switches to safely distribute electrical power therefrom. If the boat does not include an AC distribution panel, the apparatus 20 further comprises an AC distribution panel 70 that can be installed inboard (usually in an area enclosed by a roof 72, e.g., a cabin or locker, not shown, that is not exposed to the elements). The distribution panel 70 comprises a plurality of AC power outlets 74 for the boat's onboard appliances. The panel 70 also includes a circuit breaker switch 76 for safety.

In addition, the electrical control circuit 38 comprises speed control means which comprises a regulation means 39 (e.g., a solenoid valve, fuel injection metering means, temperature sensor, and includes other motor speed control means known to those skilled in the art) coupled to the electrical control circuit 38 via an electrical conductor 41 for controlling the fuel flow to the motor 34 as required according to the electrical demand. In particular, in order to maintain the regulation and frequency of the electrical power generated, it may be necessary to increase or decrease the motor 34 speed. Thus, the electrical control circuit 38 can effect motor 34 control via the speed control means. It should be understood that it is within the broadest scope of this invention to include those motors 34 that comprise internal governors that regulate engine speed according to the loading; where the motor 34 includes such an internal regulator, the speed control means is not required.

Furthermore, a main circuit breaker 51 in the housing 28 is coupled to the electrical control circuit 38 for safety and opens up should any short/fault occur when the onboard appliances are plugged into the outlets 74. The operator can reset the breaker 41 by opening a dedicated hatch 75 near the top of the housing 28.

When an internal combustion engine is used for the motor 34, battery power and fuel are required for the engine operation. In particular, a pair of insulated electrical conductors 78A/78B (12VDC and ground, respectively) are coupled between the engine 34 and the boat's onboard battery 80. These conductors 78A/78B are also fed through the boat's hull using a water-proof grommet 82. Furthermore, a fuel supply line 84 having a quick-disconnect 86 is coupled between the engine 34 and the boat's fuel tank 88, the latter of which is located below the boat's deck 89. A water-proof grommet 90 is used in the boat hull for passage of the fuel supply line 84 to the boat's fuel tank 88.

The housing 28 is a water-resistant compartment that provides a dry, water-tight environment for the motor 34, alternator/generator 36, etc., and utilizes water-proof grommets 92 at the pierce points for the electrical conductors 78A/78B and for the fuel supply line 84. The housing 28 also comprises an upper casing 94A and a lower casing 94B. The lower casing 94B comprises an air intake vent 96 for providing the necessary venting to supply fresh air to operate the engine 34, as well as providing sound dampening to reduce engine 34 noise level. Upon removal of the upper casing 94A, service and maintenance can be performed on the apparatus 20.

The housing 28 is releasably coupled to the inboard-powered boat 22 and to the outboard-powered boat 24 via respective releasable coupling mechanisms (98 as shown in FIGS. 1–3, or 198 as shown in FIG. 5). It should be understood that these coupling mechanisms 98/198 are by way of example only and are not limited to these structures.

In particular, the releasable coupling mechanism 98 (FIGS. 2–3) forms a square-bayonet sleeve assembly that prevents rotation of the apparatus 20 when the submergible extension 30 is positioned in the water. The coupling mechanism 98 comprises a sleeve portion 100A that includes a mounting plate 102A that is secured to the boat's hull via securing means 103 (e.g., screws). The coupling mechanism 98 also comprises a bayonet portion 100B that includes its own mounting plate 102B. As can be seen most clearly in FIG. 2, with the bayonet portion 100B inserted into the sleeve portion 100A, the apparatus 20 is releasably secured to the boat 22. To disengage the apparatus 20 from the boat 22, the operator needs to disconnect the power cable 64, the electrical conductors 78A/78B and the fuel supply line 84. Next, the apparatus 20 can be lifted upwards to remove the bayonet portion 100B out of the sleeve portion 100A. To engage the apparatus 20 with the boat 22, the opposite procedure is followed.

For releasably coupling the apparatus 20 to an outboard-powered boat, the coupling mechanism 198 is used (FIG. 5). The coupling mechanism 198 basically comprises a C-clamp 200. The C-clamp 200 includes a mounting plate 202 that is secured to the housing 28. A C-member 204 is secured to the mounting plate 202 and includes a curved upper portion 206 that fits around the transom 207 the boat 24. An adjustable means 208 (e.g., screws, only one of which is shown) penetrates the upper portion 206 and releasably secures the C-member 204 against the transom 207.

Figure 6:
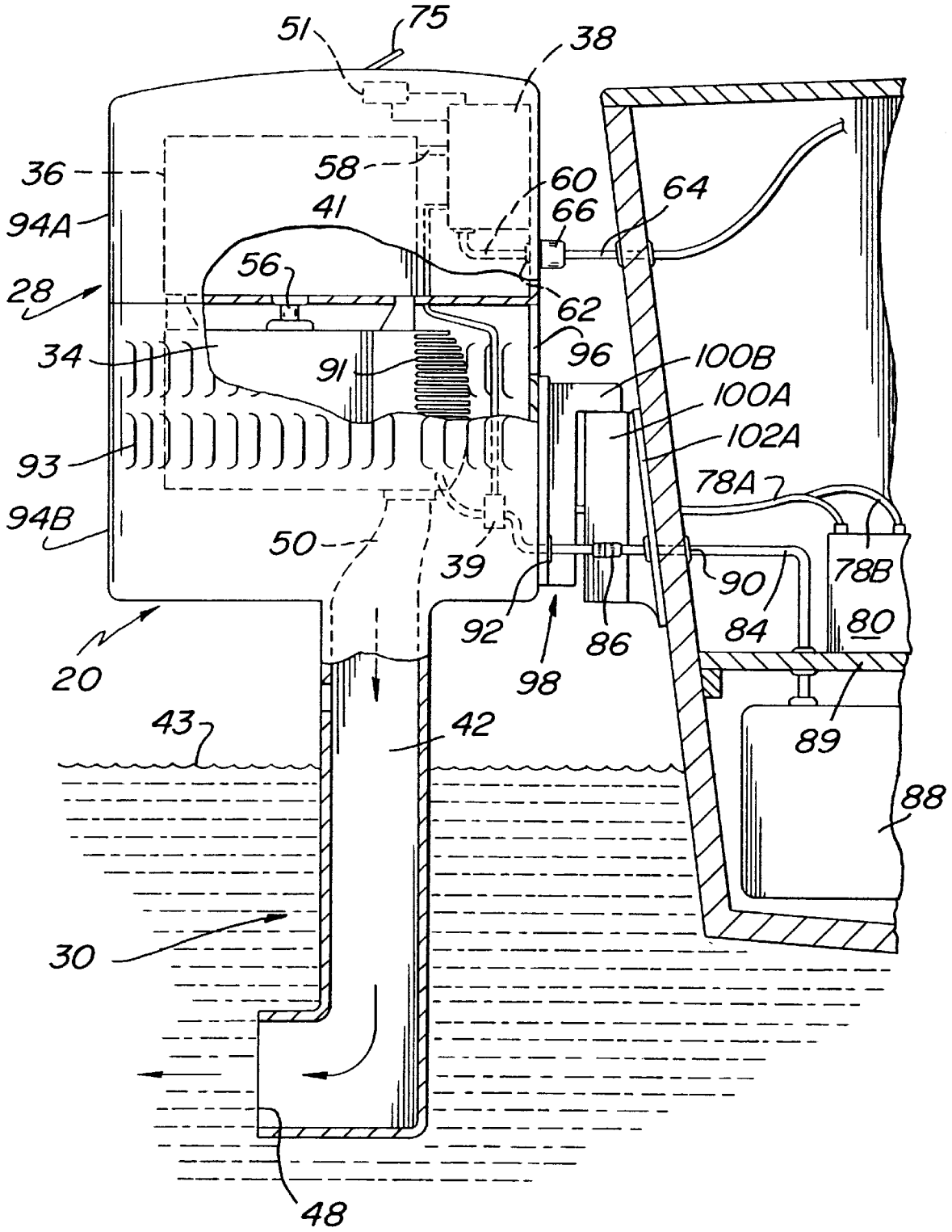
FIG. 6 is an elevated cross-sectional view of an air-cooled embodiment of the present invention coupled at the stern of the inboard-powered boat.

In FIG. 6, there is shown a second embodiment of the apparatus 20 wherein the motor 34 is an air-cooled internal combustion engine. As a result, the submergible extension 30 comprises only the exhaust plenum 42 and the raw-water, self-priming pump 32 is omitted. In addition, the motor 34 includes heat dissipating means (e.g., louvers 91) for dissipating heat generated by the motor 34 during operation; furthermore, the housing 28 comprises louvers 93 for passing the heat out of the housing 28. In all other respects, the operation of the air-cooled motor 34 is similar to that described earlier with regard to the water-cooled motor 34. Furthermore, where an air-cooled motor 34 is used, the alternator/generator 36 can be cooled by air also.

The apparatus 20 is light-weight (e.g., approximately 125 pounds) in comparison to conventional onboard generator sets. In particular, the internal combustion engine 34 used is aluminum, rather than the much heavier cast-iron engines used in the conventional onboard generator sets. Furthermore, the housing 28 is formed of a light-weight material such as fiberglass.

Both the internal combustion engine 34 and alternator/generator 36 of the present invention are fully-marinized for boat operation. It should be understood that the internal combustion engine 34 can be any internal combustion engine known to one skilled in the art, such as, but not limited to, 2-stroke/4-stroke technology and/or diesel; similarly, the alternator/generator 36 of the present invention can be any alternator/generator known to one skilled in the art for generation of electrical power in the 120VAC/240VAC @ 50–60 Hz range.

Thus, the apparatus 20 addresses the need for an economical and safe installation of a self-contained outboard electrical power generating system that attaches to the transom of a small boat to provide the necessary electrical power for appliances and electrical accessories when away from the convenience of a dockside shore power supply. This outboard electrical power generating system is independent of the boat's propulsion system and therefore can supply electrical power, when the propulsion engines are not running. In the case of a sailboat, electrical power can be supplied while underway by sail. While tied up to a dock, the electricity for the appliances and electrical accessories on a boat is supplied by a shore power cable.

Without further elaboration, the foregoing will so fully illustrate my invention that others may, by applying current or future knowledge, readily adopt the same for use under various conditions of service.

I claim:

1. An apparatus for generating electrical power for equipment on board a water vessel that is away from dock or shore, said apparatus comprising:

a motor coupled to a fuel source, said motor operating by consuming fuel from said fuel source;

an exhaust plenum, having an output portion submerged in the water, coupled to said motor for removing exhaust gases generated by said motor via said output portion;

said motor driving an electrical generation means for generating electrical power for use by the equipment;

a cable coupled between said electrical generation means and at least one onboard electrical outlet to which the equipment is electrically-coupled;

a housing, containing said motor and said electrical generation means, and comprising coupling means for coupling said housing outboard of the boat; and said apparatus operating independent of any propulsion device of the water vessel and operating independent of water vessel motion.

2. The apparatus of claim 1 wherein said electrical generation means further comprises an electrical control circuit for regulating said electrical power.

3. The apparatus of claim 2 wherein said electrical power is 50–40 Hz and 240 volts.

4. The apparatus of claim 2 wherein said electrical power is 50–60 Hz and 120 volts.

5. The apparatus of claim 1 wherein said coupling means is a releasable coupling means.

6. The apparatus of claim 1 wherein said housing is water-tight.

7. The apparatus of claim 1 wherein the water vessel is an inboard-powered boat.

8. The apparatus of claim 1 wherein the water vessel is an outboard-powered boat.

9. The apparatus of claim 1 wherein the water vessel is a sailboat.

10. The apparatus of claim 1 wherein said motor is an internal combustion engine and wherein said apparatus further comprises:

a fuel line coupled between said internal combustion engine and a fuel source onboard said water vessel; and a water intake plenum including a pump for intaking water through said plenum for cooling said internal combustion engine, said water intake having an input portion submerged in the water.

11. The apparatus of claim 10 wherein said electrical generation means further comprises an electrical control circuit for regulating said electrical power.

12. The apparatus of claim 11 wherein said electrical power is 50–60 Hz and 240 volts.

13. The apparatus of claim 11 wherein said electrical power is 50–60 Hz and 120 volts.

14. The apparatus of claim 10 wherein said coupling means is a releasable coupling means.

15. The apparatus of claim 10 further comprising battery power cables that are coupled between said internal combustion engine and a battery onboard said water vessel.

16. The apparatus of claim 10 wherein said exhaust plenum comprises a vent hole that is positioned above the water.

17. The apparatus of claim 10 wherein said electrical generation means is an alternator for generating electrical power.

18. The apparatus of claim 10 wherein said internal combustion engine comprises aluminum.

19. The apparatus of claim 11 wherein said electrical control circuit comprises means for controlling the speed of said internal combustion engine.

20. The apparatus of claim 1 wherein said motor is an internal combustion engine and wherein said apparatus further comprises:

a fuel line coupled between said internal combustion engine and a fuel source onboard said water vessel; and heat dissipating means on said internal combustion engine and on said housing for air-cooling said internal combustion engine.

21. The apparatus of claim 20 wherein said electrical generation means further comprises an electrical control circuit for regulating said electrical power.

22. The apparatus of claim 21 wherein said electrical power is 50–60 Hz and 240 volts.

23. The apparatus of claim 21 wherein said electrical power is 50–60 Hz and 120 volts.

24. The apparatus of claim 20 wherein said coupling means is a releasable coupling means.

25. The apparatus of claim 20 further comprising battery power cables that are coupled between said internal combustion engine and a battery onboard said water vessel.

26. The apparatus of claim 20 wherein said exhaust plenum comprises a vent hole that is positioned above the water.

27. The apparatus of claim 20 wherein said electrical generation means is an alternator for generating electrical power.

28. The apparatus of claim 20 wherein said internal combustion engine comprises aluminum.

29. The apparatus of claim 21 wherein said electrical control circuit comprises means for controlling the speed of said internal combustion engine.

* * * * *